US006306801B1

(12) United States Patent
Yagishita et al.

(10) Patent No.: US 6,306,801 B1
(45) Date of Patent: Oct. 23, 2001

(54) LUBRICATING OIL COMPOSITION COMPRISING ACYLATED BISSUCCINIMIDE, ZINC DITHIOPHOSPHATE AND METALLIC DETERGENT

(75) Inventors: Kazuhiro Yagishita; Yoko Matsuyama; Osamu Kurosawa, all of Yokohama (JP)

(73) Assignee: Nippon Mitsubishi Oil Corporation, Tokyo (JP)

( * ) Notice: Subject to any disclaimer, the term of this patent is extended or adjusted under 35 U.S.C. 154(b) by 0 days.

(21) Appl. No.: 09/422,868

(22) Filed: Oct. 21, 1999

(30) Foreign Application Priority Data

Oct. 22, 1998 (JP) ..... 10-301067

(51) Int. Cl.[7] ..... C10M 141/10

(52) U.S. Cl. ..... 508/292; 508/391; 508/398; 508/399; 508/433; 508/440; 508/460; 508/586

(58) Field of Search ..... 508/290, 291, 508/292, 391, 398, 399, 460, 586, 440, 433

(56) References Cited

U.S. PATENT DOCUMENTS 3,367,943 * 2/1968 Miller et al. .
4,137,185 * 1/1979 Gardiner et al. .
4,482,464 * 11/1984 Karol et al. .
5,221,491 * 6/1993 Roper et al. .
5,445,750 * 8/1995 Chafetz et al. .
5,460,740 * 10/1995 Migdal et al. .

* cited by examiner

*Primary Examiner*—Jerry D. Johnson

(57) ABSTRACT

A lubricating oil composition having an excellent sludge formation inhibiting effect and being suitable for use as an engine oil is provided. The lubricating oil composition includes: a lubricating base oil, (A) 0.5 to 20% by mass of acylated bissuccinimide, (B) 0.05 to 0.3% by mass of zinc dithiophosphate in terms of the phosphorus content, and (C) 0.5 to 4.0% by mass of metallic detergent in terms of the sulfated ash content, based on the total mass of the composition.

19 Claims, No Drawings

LUBRICATING OIL COMPOSITION COMPRISING ACYLATED BISSUCCINIMIDE, ZINC DITHIOPHOSPHATE AND METALLIC DETERGENT

BACKGROUND OF THE INVENTION

1. Field of the Invention

The present invention relates to a lubricating oil composition, and more particularly, to a lubricating oil composition which is excellent in sludge formation inhibiting effect, and hence is suitable especially for use as an engine oil.

2. Background Art

In a gasoline engine, sludge is formed due to the oxidative deterioration of an engine oil at high temperatures, and the reaction between the engine oil and unburnt fuel, blow-by gas (especially $NO_x$), or the like. The sludge formed causes engine troubles such as blockage of an oil path or a valve, and an increase in viscosity of the engine oil. Therefore, the engine oil is required to be capable of inhibiting the sludge formation as much as possible so as not to cause the engine troubles. The engine oil has been used under very severe conditions with the trend toward the higher output of a gasoline engine and the smaller capacity of an oil pan for the engine, oil for the purpose of saving energy especially in recent years. Accordingly, a higher sludge formation inhibiting effect has been required of the engine oil.

The engine oil is generally manufactured by adding additives such as ashless dispersant, friction inhibitor, and metallic detergent to a lubricating base oil. In general, polybutenylsuccinimide has been used as the ashless dispersant in conventional engine oils. However, the sludge formation inhibiting effect exerted by polybutenylsuccinimide has still been unsatisfactory for establishing the technology to increase the life of the engine oil.

SUMMARY OF THE INVENTION

It is an object of the present invention to provide a lubricating oil composition which exhibits an extremely excellent effect of inhibiting sludge formation, ensuring its longer life especially when the composition is used as a gasoline engine oil.

The present inventors have conducted intensive study to develop a lubricating oil more excellent in sludge formation inhibiting effect. As a result, they have found that a lubricating oil containing acylated bissuccinimide, zinc dithiophosphate, and a metallic detergent each in a specific amount has an extremely excellent sludge formation inhibiting effect. Thus, the present invention has been accomplished.

Namely, the present invention provides a lubricating oil composition which comprises: a lubricating base oil; (A) 0.5 to 20% by mass of acylated bissuccinimide; (B) 0.05 to 0.3% by mass of zinc dithiophosphate in terms of the phosphorus content; and (C) 0.5 to 4.0% by mass of a metallic detergent in terms of the sulfated ash content, based on the total mass of the composition.

The lubricating oil composition of the present invention exhibits an extremely excellent effect of inhibiting sludge formation, which ensures its longer life especially when the composition is used as a gasoline engine oil.

The lubricating oil composition of the present invention is preferably used especially as a gasoline engine oil. In addition, it is also preferably used as a lubricating oil which will suffer the troubles caused by sludge formation due to thermal/oxidative degradation, and the like of the lubricating oil. Specific examples of such a lubricating oil include diesel engine oils, two-cycle engine oils, automobile gear oils, ATF oils, non-stage transmission oils, shock absorber oils, and hydraulic actuation oils.

DETAILED DESCRIPTION OF THE PREFERRED EMBODIMENTS

The present invention will be described in more detail hereinafter.

As the lubricating base oil in the lubricating oil composition of the present invention, any mineral oils and/or synthetic oils serving as common lubricating base oils can be used.

As the mineral oils, oils of paraffinic series, naphthenic series, and the like, normalparaffins, and the like obtained in the following manner can be used. Specifically, for example, paraffinic or naphthenic crude oils are subjected to atmospheric distillation and vacuum distillation to produce a lubricating oil fraction. The resulting fraction is subjected to one or an appropriate combination of two or more of refining processes such as solvent deasphalting, solvent extraction, hydrocracking, solvent dewaxing, catalytic dewaxing, hydrorefining, washing with sulfuric acid, and clay treatment. When two or more refining processes are performed, the respective refining processes can be combined in any order, and the same refining process may be repeated plural times each under different conditions.

Although synthetic oils have no particular restriction, there can be used one or more compounds selected from poly-α-olefins such as 1-octene oligomer, 1-decene oligomer, ethylene-propylene oligomer, and the like, and hydrides thereof, isobutene oligomer and hydrides thereof, isoparaffin, alkylbenezene, alkylnaphthalene, diesters such as ditridecyl glutarate, di-2-ethylhexyl adipate, diisodecyl adipate, ditridecyl adipate, di-2-ethylhexylsebacate and the like, polyol esters such as trimethylolpropane caprylate, trimethylolpropane pelargonate, pentaerythritol-2-ethyl hexanoate, pentaerythritol pelargonate, and the like, polyoxyalkylene glycol, dialkyldiphenyl ether, polyphenyl ether, and the like.

As the lubricating base oils to be used in the present invention, a mixture of the mineral lubricating base oil and synthetic lubricating base oil in any proportions, so-called semi-synthetic oils can also preferably be used.

Although the kinematic viscosity at 100° C. of the lubricating base oil to be used in the present invention have no particular restriction, it is preferably in a range of 1.0 to 10 $mm^2/s$, more preferably in a range of 2.0 to 8 $mm^2/s$.

When the kinematic viscosity at 100° C. of the lubricating base oil is 1.0 $mm^2/s$ or more, it becomes possible to obtain a lubricating oil composition more excellent in lubricity due to sufficient oil film formation, with lower evaporation losses of the base oil under high temperature conditions.

Whereas, with a kinematic viscosity at 100° C. of 10 $mm^2/s$ or less, it becomes possible to obtain a lubricating oil composition having decreased flow resistance and hence decreased friction resistance at the site of lubrication.

Although the viscosity index of the lubricating base oil also has no particular restriction, it is preferably 80 or more, more preferably 100 or more. A viscosity index of 80 or more can result in a lubricating oil composition more ensuring the compatibility between its oil film forming capability and flow resistance reducing capability.

Although the pour point of the lubricating base oil also has no particular restriction, it is preferably 0° C. or less, more preferably −5° C. or less. A pour point of 0° C. or less can result in a lubricating oil composition whereby the operation of a machine is less hindered at low temperatures.

The component (A) in the lubricating oil composition of the present invention is acylated bissuccinimide.

Specific examples of the acylated bissuccinimide include compounds represented by the following general formula (1):

(1)

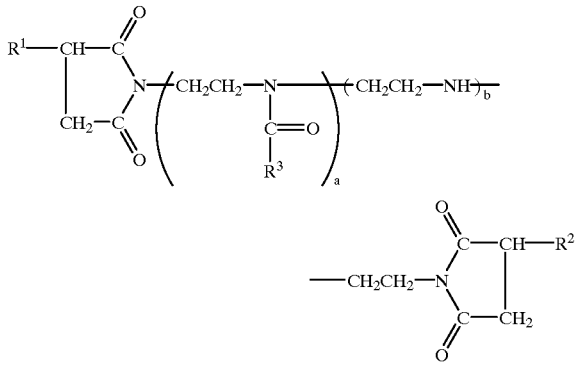

where $R^1$ and $R^2$ are each independently a straight or branched alkyl or alkenyl group having 40 to 400 carbon atoms. Examples of $R^1$ and $R^2$ include branched alkenyl groups and branched alkyl groups which are hydrides of branched alkenyl groups, derived from polypropylene, ethylene-propylene oligomer, polyisobutylene, and the like, having a number-average molecular weight of 1000 to 2000.

In the above formula (1), $R^3$ denotes a hydrogen atom, an alkyl or alkenyl group having 1 to 24 carbon atoms, an alkoxy group having 1 to 24 carbon atoms, or a hydroxy (poly)oxyalkylene group represented by the following formula (2):

$$-O-(R^4O)_cH \quad (2)$$

Specific examples of the alkyl or alkenyl group having 1 to 24 carbon atoms referred to herein include alkyl groups such as methyl, ethyl, propyl, butyl, pentyl, hexyl, heptyl, octyl, nonyl, decyl, undecyl, dodecyl, tridecyl, tetradecyl, pentadecyl, hexadecyl, heptadecyl, octadecyl, nonadecyl, eicosyl, heneicosyl, docosyl, tricosyl, and tetracosyl groups (these alkyl groups may be straight or branched ones); and alkenyl groups such as butenyl, pentenyl, hexenyl, heptenyl, octenyl, nonenyl, decenyl, undecenyl, dodecenyl, tridecenyl, tetradecenyl, pentadecenyl, hexadecenyl, heptadecenyl, octadecenyl, nonadecenyl, eicosenyl, heneicosenyl, docosenyl, tricocenyl, and tetracosenyl groups (these alkenyl groups may be straight or branched ones, and may have double bonds at any positions).

Specific examples of the alkoxy groups having 1 to 24 carbon atoms include alkoxy groups such as methyloxy (methoxy), ethyloxy (ethoxy), propyloxy (propoxy), butyloxy (butoxy), pentyloxy, hexyloxy, heptyloxy, octyloxy, nonyloxy, decyloxy, undecyloxy, dodecyloxy, tridecyloxy, tetradecyloxy, pentadecyloxy, hexadecyloxy, heptadecyloxy, octadecyloxy, nonadecyloxy, eicosyloxy, heneicosyloxy, docosyloxy, tricosyloxy, and tetracosyloxy groups (the alkyl groups in the alkoxy groups may be straight or branched ones).

In the above general formula (2), $R^4$ denotes an alkylene group having 1 to 4 carbon atoms. Specific examples thereof include alkylene groups such as methylene, ethylene, methylmethylene, propylene (methylethylene), ethylmethylene, trimethylene, butylene (ethylethylene), dimethylethylene, n-propylmethylene, isopropylmethylene, methyltrimethylene, and tetramethylene groups (the methyl groups and ethyl groups may be bonded to any positions). In the general formula (2), c is an integer of 1 to 5, preferably 1 to 4.

It is noted that $R^3$ in the above general formula (1) is preferably a hydrogen atom, an alkyl group having 1 to 12 carbon atoms, an alkoxy group having 1 to 12 carbon atoms, or a hydroxy(poly)oxyalkylene group represented by the above general formula (2) where $R^4$ is an alkylene group having 2 or 3 carbon atoms, and c is an integer of 1 to 4, from the viewpoint of excellence in sludge formation inhibiting effect.

Further, in the above general formula (1), a is an integer of 1 to 4, b is an integer of 0 to 3, and a+b=1 to 4. Preferably, a is 2 to 4, b is 0 to 2, and a+b=2 to 4, more preferably, a is 3 or 4, b is 0 or 1, and a+b=3 or 4, from the viewpoint of excellence in sludge formation inhibiting effect.

Namely, in acylated bissuccinimide represented by the above general formula (1), the group represented by the general formula (3) below includes 1 to 4, preferably 2 to 4, more preferably 3 or 4 structural units represented by the following formula (4), and 0 to 3, preferably 0 to 2, more preferably 0 or 1 structural unit represented by the following general formula (5). Further, it includes a total of 1 to 4, preferably 2 to 4, more preferably 3 or 4 structural units represented by the general formulae (4) and (5) in all.

(3)

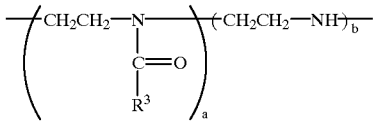

(where $R^3$ denotes the same group as $R^3$ in the general formula (1), and a and b are the same integers of a and b in the general formula (1), respectively.)

(4)

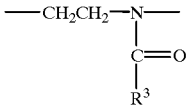

(where $R^3$ denotes the same group as $R^3$ in the general formula (1))

$$—CH_2CH_2—NH— \quad (5)$$

More specifically, the group represented by the general formula (3) denotes a group resulting from the following polymers ① to ④:

① Homopolymer comprising one structural unit represented by the general formula (4) (when b=0), ② Random copolymer, alternating copolymer, or block copolymer comprising two or more different structural units included in the general formula (4) (when b=0), ③ Random copolymer, alternating copolymer, or block copolymer comprising one structural unit represented by the general formula (4), and a structural unit represented by the general formula (5) (when b≠0), and ④ Random copolymer, alternating copolymer, or block copolymer comprising two or more different structural units included in the general formula (4), and a structural unit represented by the general formula (5) (when b≠0).

It is noted that, in expressing the component (A) according to the present invention by a chemical structural formula, the component (A) is represented by the general formula (1) wherein the structural unit represented by the general formula (4) is bonded to the group represented by the following formula (6), and the structural unit represented by the general formula (5) is bonded to the group represented by the following general formula (7), but this expression is for convenience in writing. The bonding order of the structural unit of the general formula (4) and the structural unit of the general formula (5) is not limited to the bonding order shown in the general formula (1) as described above.

(6)

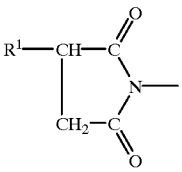

(where $R^1$ denotes the same group as $R^1$ in the general formula (1)).

(7)

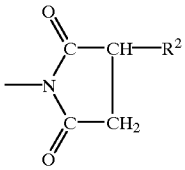

(where $R^2$ denotes the same group as $R^2$ in the general formula (1)).

The component (A) of the present invention is more preferably, from the viewpoint of excellence in sludge formation inhibiting effect, acylated bissuccinimide represented by the general formula (1) where $R^1$ and $R^2$ are each independently a branched alkenyl group having 40 to 400 carbon atoms or a branched alkyl group having 40 to 400 carbon atoms which is a hydride of the alkenyl group, derived from polypropylene, ethylene-propylene oligomer, polyisobutylene, or the like, having a number-average molecular weight of 900 to 3500; $R^3$ is a hydrogen atom, an alkyl group having 1 to 12 carbon atoms, an alkoxy group having 1 to 12 carbon atoms, or a hydroxy(poly)oxyalkylene group represented by the general formula (2) where $R^4$ is an alkylene group having 2 or 3 carbon atoms, and c is an integer of 1 to 4; and a is an integer of 2 to 4, b is an integer of 0 to 2, and a+b=2 to 4.

The component (A) of the present invention is most preferably, from the viewpoint of excellence in sludge formation inhibiting effect, acylated bissuccinimide represented by the general formula (1) where $R^1$ and $R^2$ are each independently a branched alkenyl group having 40 to 400 carbon atoms or a branched alkyl group of 40 to 400 carbon atoms which is a hydride of the alkenyl group, derived from polypropylene, ethylene-propylene oligomer, polyisobutylene, or the like, having a number-average molecular weight of 1000 to 2000; $R^3$ is a hydrogen atom, an alkyl group having 1 to 12 carbon atoms, an alkoxy group having 1 to 12 carbon atoms, or a hydroxy(poly)oxyalkylene group represented by the general formula (2) where $R^4$ is an alkylene group having 2 or 3 carbon atoms, and c is an integer of 1 to 4; and a is an integer of 3 or 4, b is an integer of 0 or 1, and a+b=3 or 4.

It is noted that, although the production method of the above-described acylated bissuccinimide has no particular restriction, preferable examples thereof typically include the following methods.

That is, there is included a method in which bissuccinimide represented by the following general formula (8) is allowed to react with organic carboxylic acid represented by the following general formula (9), acid chloride of organic carboxylic acid represented by the following general formula (10), or the like:

(8)

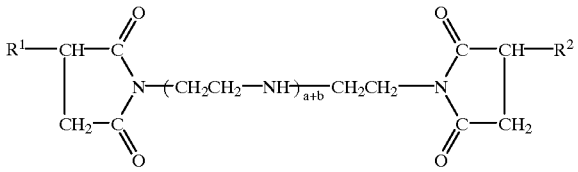

(where $R^1$ and $R^2$ denote the same groups as $R^1$ and $R^2$ in the general formula (1), respectively, and a and b also denote the same integers as a and b in the general formula (1), respectively.)

(9)

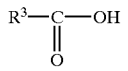

(where $R^3$ denotes the same group as $R^3$ in the general formula (1)), (10)

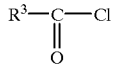

(where $R^3$ denotes the same group as $R^3$ in the general formula (3)).

Any conditions under which both the compounds are allowed to react with each other can be adopted. For example, the acylated bissuccinimide of the general formula (1) where $R^3$ is a hydrogen atom can be obtained in the following manner. That is, bissuccinimide represented by the general formula (8) and formic acid (a compound represented by the general formula (9) where $R^3$ is a hydrogen atom) are mixed and allowed to react under reflux at a reaction temperature of 70 to 150° C., preferably 90 to 130° C. for 1 to 5 hours, preferably 2 to 4 hours, followed by fractional distillation.

Further, the acylated bissuccinimide represented by the general formula (1) where $R^3$ is a methoxy group can be obtained in the following manner. That is, bissuccinimide represented by the general formula (8) and methyl chloroformate (a compound represented by the general formula (10) where $R^3$ is a methoxy group) are mixed and allowed to react under reflux at a reaction temperature of 30 to 70° C., preferably 40 to 60° C. for 1 to 5 hours, preferably 2 to 4 hours, followed by fractional distillation.

As the component (A) of the present invention, derivatives of the above-described acylated bissuccinimide can also be used.

Specific examples of the derivatives include so-called polycarboxylic acid modified compounds obtained by allowing polycarboxylic acid having 2 to 30 carbon atoms such as oxalic acid, phthalic acid, trimellitic acid, or pyromellitic acid to act on the above-described acylated bissuccinimide to neutralize or amidate a part of, or the whole of the remaining amino groups and/or imino groups; sulfur modified compounds obtained by allowing a sulfur compound to act on the above-described acylated bissuccinimide; and so-called boron modified compounds obtained by modifying the acylated bissuccinimide, or a polycarboxylic acid modified product or sulfur modified product thereof by a boron compound such as boric acid, boric acid salt or boric acid ester.

The content of the component (A) in the lubricating oil composition of the present invention has a lower limit value of 0.5% by mass, preferably 1.0% by mass based on the total mass of the lubricating oil composition. On the other hand, the content has an upper limit value of 20% by mass, preferably 15% by mass based on the total mass of the lubricating oil composition. When the component (A) content is less than 0.5% by mass based on the total mass of the lubricating oil composition, the sludge formation inhibiting effect resulting from the presence of the component (A) scarcely shows an improvement. Meanwhile, when it exceeds 20% by mass based on the total mass of the composition, the low-temperature fluidity of the composition largely deteriorates. Thus, both the cases are not preferred.

The component (B) in the lubricating oil composition of the present invention is zinc dithiophosphate.

Specific examples of zinc dithiophosphate include compounds represented by the following general formula (11):

(11)

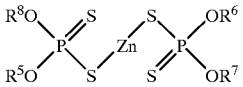

where, $R^5$, $R^6$, and $R^7$ and $R^8$ denote each independently an alkyl group or aryl group having 1 to 18 carbon atoms, or an alkylaryl group having 7 to 18 carbon atoms.

Specific examples of the alkyl group include methyl, ethyl, propyl, butyl, pentyl, hexyl, heptyl, octyl, nonyl, decyl, undecyl, dodecyl, tridecyl, tetradecyl, pentadecyl, hexadecyl, heptadecyl, and octadecyl groups. Especially, alkyl groups having 3 to 8 carbon atoms are generally used. These alkyl groups may be straight or branched ones, and may also be primary alkyl groups or secondary alkyl groups.

Further, a mixture of α-olefins may be used as a raw material when, $R^5$, $R^6$, and $R^7$ and $R^8$ are introduced thereinto. In such a case, a mixture of zinc dialkyldithiophosphate having alkyl groups of mutually different structures is provided as the compound represented by the general formula (11).

Specific examples of the aryl group include phenyl and naphthyl groups.

Specific examples of the alkylaryl group include tolyl, xylyl, ethylphenyl, propylphenyl, butylphenyl, pentylphenyl, hexylphenyl, heptylphenyl, octylphenyl, nonylphenyl, decylphenyl, undecylphenyl, and dodecylphenyl groups (these alkyl groups may be straight or branched ones, and may also be all the substitution isomers thereof).

More preferable examples of zinc dithiophosphate specifically include zinc dipropyldithiophosphate, zinc dibutyldithiophosphate, zinc dipentyldithiophosphate, zinc dihexyldithiophosphate, zinc diheptyldithiophosphate, and zinc dioctyldithiophosphate (these alkyl groups maybe straight or branched ones), and mixtures thereof. Zinc dialkyldithiophosphate having alkyl groups mutually different in number of carbon atoms (of 3 to 8 carbon atoms) and/or mutually different in structure in one molecule can also be preferably used.

The content of the component (B) in the lubricating oil composition of the present invention has a lower limit value of 0.05% by mass, preferably 0.07% by mass in terms of the phosphorus content based on the total mass of the lubricating oil composition. On the other hand, the content has an upper limit value of 0.3% by mass, preferably 0.25% by mass in terms of the phosphorus content based on the total mass of the lubricating oil composition. When the component (B) content is less than 0.05% by mass in terms of the phosphorus content based on the total mass of the lubricating oil composition, the sludge formation inhibiting effect resulting from the presence of the component (B) scarcely shows an improvement. Meanwhile, when it exceeds 0.3% by mass in terms of the phosphorus content based on the total mass of the lubricating oil composition, the oxidation stability of the composition deteriorates. Thus, both the cases are not preferred.

The component (C) in the lubricating oil composition of the present invention is a metallic detergent.

Although any total base numbers of the metallic detergent of the component (C) can be selected, the lower limit value thereof is preferably 20 mgKOH/g, more preferably 100 mgKOH/g. Meanwhile, the upper limit value thereof is preferably 500 mgKOH/g, more preferably 450 mgKOH/g. When the total base number is less than 20 mgKOH/g, the oxidation stability of the lubricating oil composition may be deteriorated. On the other hand, when the total base number exceeds 500 mgKOH/g, the storage stability of the composition may be adversely affected. Thus, both the cases are not preferred. It is noted that the total base number referred to herein denotes the total base number determined in accordance with "7. Potentiometric titration (base number, perchloric acid method)" of JIS K2501-1992 "Petroleum products and lubricants—Determination of neutralization number".

Specific examples of the metal include alkali metals such as sodium and potassium, alkaline earth metals such as magnesium, calcium, and barium, and zinc. Especially, alkaline earth metals are preferred.

More preferred examples of the metallic detergent of the component (C) include one or more basic alkaline earth metal detergents selected from (C-1) basic alkaline earth metal sulfonate having a total base number of 100 to 450 mgKOH/g, (C-2) basic alkaline earth metal phenate having a total base number of 20 to 450 mg KOH/g, and (C-3) basic alkaline earth metal salicylate having a total base number of 100 to 450 mgKOH/g.

More specific examples of alkaline earth metal sulfonate include alkaline earth metal salts of alkyl aromatic sulfonic acid obtained by sulfonating an alkyl aromatic compound having a molecular weight of 100 to 1500, preferably 200 to 700. The alkaline earth metal salts are preferably magnesium salts and/or calcium salts, more preferably calcium salts. Specific examples of the alkyl aromatic sulfonic acid include so-called petroleum sulfonic acids and synthetic sulfonic acids.

As the petroleum sulfonic acids, the acids obtained by sulfonating an alkyl aromatic compound extracted from the lubricating oil fraction of a mineral oil, and so-called mahogany acid and the like by-produced during the manufacture of a white oil are generally used. As the synthetic sulfonic acids, alkylbenzenesulfonic acid, dinonylnaphthalenesulfonic acid, and the like are used. The alkylbenzenesulfonic acid is obtained in the following manner. Straight or branched alkylbenzene is by-produced in a manufacturing plant of alkylbenzene to serve as a raw material for a detergent. Alternatively, straight or branched alkylbenzene is obtained by alkylating polyolefin into benzene. The resulting alkylbenzenes are used as raw materials to be sulfonated, resulting in alkylbenzenesulfonic acids. Whereas the dinonylnaphthalenesulfonic acid is obtained by sulfonating dinonylnaphthalene. Although there is no particular restriction on the sulfonating agent for sulfonating alkyl aromatic compounds, fuming sulfuric acid and sulfuric acid are commonly used.

More specific examples of the alkaline earth metal phenate include alkaline earth metal salts of alkylphenol having at least one straight or branched alkyl group having 4 to 30, preferably 6 to 18 carbon atoms; alkaline earth metal salts of alkylphenolsulfide obtained by reacting the above-described alkylphenol and a sulfur element; and alkaline earth metal salts of methylenebisalkylphenol obtained by subjecting the alkylphenol and acetone to condensation dehydration reaction. Preferably calcium salts and/or magnesium salts, more preferably calcium salts are used.

More specific examples of the alkaline earth metal salicylate include alkaline earth metal salts of alkylsalicylic acid having at least one straight or branched alkyl group having 4 to 30, preferably 6 to 18 carbon atoms. Preferably calcium salts and/or magnesium salts, more preferably calcium salts are used.

The (C-1) basic alkaline earth metal sulfonate, (C-2) basic alkaline earth metal phenate, and (C-3) basic alkaline earth metal salicylate may be provided regardless of their respective manufacturing routes. In other words, these basic salts may be obtained by allowing alkylaromatic sulfonic acid, alkylphenol, alkylphenolsulfide, methylenebisalkylphenol, alkylsalicylic acid, or the like to directly react with alkaline earth metal bases such as oxides and hydroxides of alkaline earth metals.

The basic salts may also be obtained in the following manner. Alkylaromatic sulfonic acids or the like are once made into alkali metal salts such as sodium salts and potassium salts. The resulting alkali metal salts are then made into the corresponding alkaline earth metal salts by substitution of the alkali metals with alkaline earth metals to produce neutral salts (normal salts) . Thereafter, the neutral salts are heated with an excess of appropriate alkaline earth metal salts or alkaline earth metal bases (hydroxides or oxides of alkaline earth metals) in the presence of water to produce basic salts.

Further, the basic salts may be alkaline earth metal carbonate-containing overbasic salts (superbasic salts) obtained by making the above-described basic salts or neutral salts (normal salts) to react with alkaline earth metal bases in the presence of carbon dioxide gas.

Still further, the basic salts may be alkaline earth metal borate-containing overbasic salts (superbasic salts) obtained in the following manner. Alkaline earth metal bases are dispersed in the above-described basic salts or neutral salts (normal salts). Boric acid, boric acid salt, or boric acid ester are further placed therein to produce a calcium borate dispersion in the system. Alternatively, the above-described alkaline earth metal carbonate-containing over basic salts are allowed to react with boric acids, boric acid salts, boric acid esters. Thus, the alkaline earth metal carbonates dispersed in the system are converted into alkaline earth metal borates.

Specific examples of the boric acid referred to herein include orthoboric acid, metaboric acid, and tetraboric acid. Specific examples of the borate include alkali metal salts, alkaline earth metal salts, or ammonium salts of boric acid. More specifically, preferred examples thereof include lithium borates such as lithium metaborate, lithium tetraborate, lithium pentaborate, and lithium perborate; sodium borates such as sodium metaborate, sodium diborate, sodium tetraborate, sodium pentaborate, sodium hexaborate, and sodium octaborate; potassium borates such as potassium metaborate, potassium tetraborate, potassium pentaborate, potassium hexaborate, and potassium octaborate; calcium borates such as calcium metaborate, calcium diborate, tricalcium tetraborate, pentacalcium tetraborate, and calcium hexaborate; magnesium borates such as magnesium metaborate, magnesium diborate, trimagnesium tetraborate, pentamagnesium tetraborate, and magnesium hexaborate; and ammonium borates such as ammonium metaborate, ammonium tetraborate, ammonium pentaborate, and ammonium octaborate. Examples of boric acid ester include esters of boric acid and preferably alkylalcohol having 1 to 6 carbon atoms. Preferred examples thereof more specifically include monomethyl borate, dimethyl borate, trimethyl borate, monoethylborate, diethylborate, triethylborate, monopropylborate, dipropylborate, tripropylborate, monobutylborate, dibutylborate, and tributyl borate.

Further, these reactions are generally performed in a solvent such as an aliphatic hydrocarbon solvent such as hexane, aromatic hydrocarbon solvent such as xylene, light lubricating base oil, or the like. The metallic detergents are, in general, commercially available in a diluted form with a light lubricating base oil, or the like. Desirably, the metallic detergent to be used has a metal content, generally, in a range of 1.0 to 20% by mass, preferably in a range of 2.0 to 16% by mass.

The content of the component (C) in the lubricating oil composition of the present invention has a lower limit value of 0.5% by mass, preferably 0.7% by mass, in terms of the sulfated ash content based on the total mass of the lubricating oil composition. Meanwhile, the content thereof has a upper limit value of 4.0% by mass, preferably 3.5% by mass, in terms of the sulfated ash content based on the total mass of the lubricating oil composition. When the component (C) content is less than 0.5% by mass in terms of the sulfated ash content based on the total mass of the lubricating oil composition, the sludge formation inhibiting effect resulting from the presence of the component (C) scarcely shows an improvement. Meanwhile, a component (C) content exceeding 4.0% by mass in terms of the sulfated ash content based on the total mass of the composition deteriorates the storage stability of the lubricating oil composition. Thus, both the cases are not preferable. It is noted that the sulfated ash content referred to in the present invention denotes the sulfated ash content determined in accordance with "5. Testing method of sulfated ash" of JIS K2272-1985 "Crude oil and petroleum products—Determination of ash and sulfated ash".

In the present invention, a lubricating oil composition excellent particularly in sludge formation inhibiting effect can be obtained merely by adding the above-mentioned components (A) to (C) each in a specified amount to a lubricating base oil. Known lubricant additives such as friction modifiers, extreme-pressure additives, anti-wear agents, rust preventives, corrosion inhibitors, viscosity index improvers, pour-point depressant, rubber swelling agents, antifoamers, and coloring agents can be used singly, or in combination of several kinds thereof for the purpose of further enhancing the various performances thereof.

Examples of the friction modifier includes organometallic friction modifiers and ashless friction modifiers. Typical examples of the organometallic friction modifier include organomolybdenum compounds such as molybdenum dithiophosphate, and molybdenum dithiocarbamate. Examples of the ashless friction modifier include aliphatic monohydric alcohols, fatty acids or derivatives thereof, and aliphatic amines or derivatives thereof, having at least one alkyl or alkenyl group with 6 to 30 carbon atoms As the extreme-pressure additive and anti-wear agent, for example, sulfur-containing compounds can be used. Specific examples of the sulfur-containing compound include disulfides, olefin sulfides, and sulfide oils and fats.

Examples of the rust preventive include alkenyl succinic acids, alkenyl succinic acid esters, polyhydric alcohol esters, petroleum sulfonates, and dinonylnaphthalenesulfonate.

Examples of the corrosion inhibitor include benzotriazole, thiadiazole, and imidazole compounds.

Specific examples of the index improver include polymethacrylates; olefin copolymers such as ethylene-propylene copolymer, and hydrides thereof; and graft copolymers of styrene-diene copolymer, polymethacrylate, and olefin copolymer, or hydrides thereof.

Examples of the pour-point depressant include polymers such as polyacrylate and polymethacrylate suitable for the lubricating base oil to be used.

Examples of the antifoamer include silicones such as dimethylsilicone and fluorosilicone.

Although these additives can be added in given amounts, in general, the antifoamer content is 0.0005 to 1% by weight, the corrosion inhibitor content is 0.005 to 1% by weight, and the content of other additives is about 0.05 to 15% by weight, respectively.

The lubricating oil composition of the present invention is preferably used particularly as a gasoline engine oil. In addition, it is also preferably used as a lubricating oil which will suffer the troubles caused by sludge formation due to thermal/oxidative degradation, and the like of the lubricating oil. Specific examples of the lubricating oil include diesel engine oils, two-cycle engine oils, automobile gear oils, ATF oils, non-stage transmission oils, shock absorber oils, and hydraulic actuation oils.

EXAMPLES

Hereinafter, the present invention will be described more specifically by way of the following examples and comparative examples, which should not be construed as limiting the scope of the invention.

Examples 1 to 5

The lubricating oil compositions according to the present invention were prepared in accordance with their respective compositions shown in Table 1. The following performance evaluation tests were conducted for these compositions. The results are shown in Table 1.

Comparative Examples 1 to 5

Lubricating oil compositions for comparison were also prepared in accordance with their respective compositions shown in Table 2. The same performance evaluation tests as those in Examples 1 to 5 were also conducted for these compositions. The results are shown in Table 2.

[Sludge Inhibiting Performance Evaluation Test]

To 50 g of a test oil were added 2.5 g of tetralin and 2 g of dicyclopentadiene. $NO_x$ mixed gas (NO concentration: 5000 ppm) was blown therein at a rate of 160 ml/minute with keeping the temperature at 140° C. The test oil after 20 hours was measured for the n-pentane insoluble matter (A method). It is noted that the n-pentane insoluble matter (A method) referred to herein is a value determined in accordance with "Testing method of an insoluble matter in a lubricant used" defined in JPI 5S-18-80.

This test is for evaluating the sludge inhibiting performance of an engine oil, and it indicates that, the smaller the value is, the more excellent the sludge inhibiting performance is.

TABLE 1

| | | Example 1 | Example 2 | Example 3 | Example 4 | Example 5 |
|---|---|---|---|---|---|---|
| Com. (*) | Lubricant base oil | Refined mineral oil A[1] [89.5] | Refined mineral oil A[1] [89.5] | Refined mineral oil A[1] [89.5] | Refined mineral oil A[1] [89.5] | Refined mineral oil A[1] [89.5] |
| | Component (A) | Succinimide A[2] [5.0] | Succinimide B[3] [5.0] | Succinimide C[4] [5.0] | Succinimide A[2] [5.0] | Succinimide A[2] [5.0] |
| | Component (B) | Zinc dithiophosphate A[5] [1.5] | Zinc dithiophosphate A[5] [1.5] | Zinc dithiophosphate A[5] [1.5] | Zinc dithiophosphate B[6] [1.5] | Zinc dithiophosphate A[5] [1.5] |
| | Component (C) | Metallic detergent A[7] [4.0] | Metallic detergent A[7] [4.0] | Metallic detergent A[7] [4.0] | Metallic detergent A[7] [4.0] | Metallic detergent B[8] [4.0] |
| Sludge inhibiting performance n-pentane insoluble matter (A method) (*) | | 0.20 | 0.14 | 0.12 | 0.22 | 0.21 |

Com: Composition, (*): (% by mass)

1) Hydrogenated refined mineral oil (kinematic viscosity: 4 $mm^2/s$ (@ 100° C.), viscosity index: 120)

2) Acylated bis-polybutenylsuccinimide described below (nitrogen content: 1.86% by mass):

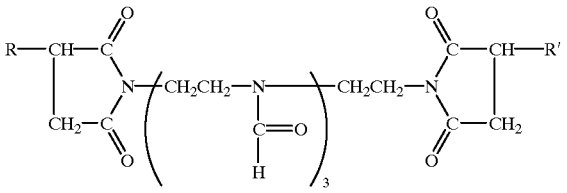

R, R': polyisobutenyl group derived from polyisobutylene having a number-average molecular weight of 1000

3) Acylated bis-polybutenylsuccinimide described below (nitrogen content: 1.81% by mass)

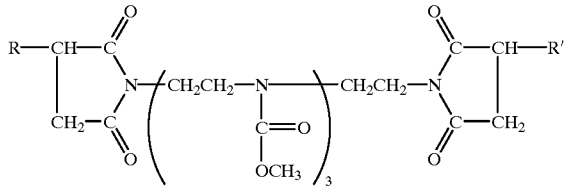

R, R': polyisobutenyl group derived from polyisobutylene having a number-average molecular weight of 1000

4) Acylated bis-polybutenylsuccinimide described below (nitrogen content: 1.86% by mass)

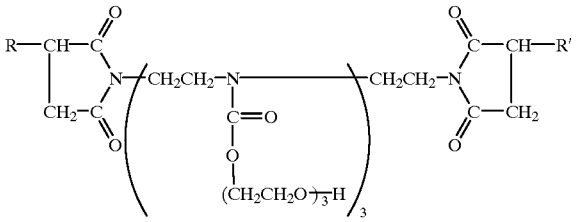

R, R': polyisobutenyl group derived from polyisobutylene having a number-average molecular weight of 1000

5) Zinc dialkyldithiophosphate (Zn content: 8.2% by mass, P content: 6.3% by mass), alkyl group: 2-ethylhexyl group 6) Zinc dialkyldithiophosphate (Zn content: 7.2% by mass, P content: 6.2% by mass), alkyl group: a mixture of a sec-butyl group and 1,3-dimethylbutyl group 7) Calcium carbonate-containing overbasic calcium sulfonate (petroleum series, total base number: 320 mgKOH/ g, Ca content: 12.5% by mass, sulfated ash content: 42.5% by mass)

8) Calcium carbonate-containing overbasic magnesium sulfonate (alkylbenzene series, total base number: 400 mgKOH/g, Mg content: 9.4% by mass, sulfated ash content: 27% by mass).

TABLE 2

| | | Comparative Example 1 | Comparative Example 2 | Comparative Example 3 | Comparative Example 4 | Comparative Example 5 |
|---|---|---|---|---|---|---|
| Com. (*) | Lubricant base oil | Refined mineral oil A[1] [94.5] | Refined mineral oil A[1] [91.0] | Refined mineral oil A[1] [93.5] | Refined mineral oil A[1] [89.5] | Refined mineral oil A[1] [89.5] |
| | Component (A) | — | Succinimide A[2] [5.0] | Succinimide A[2] [5.0] | — | — |
| | Component (B) | Zinc dithiophosphate A[3] [1.5] | — | Zinc dithiophosphate A[3] [1.5] | Zinc dithiophosphate A[3] [1.5] | Zinc dithiophosphate A[3] [1.5] |
| | Component (C) | Metallic detergent A[4] [4.0] | Metallic detergent A[4] [4.0] | — | Metallic detergent A[4] [4.0] | Metallic detergent A[4] [4.0] |
| | Others | — | — | — | Succinimide D[5] [5.0] | Succinimide E[6] [5.0] |
| Sludge inhibiting performance n-pentane insoluble matter (A method) (*) | | 2.35 | 1.54 | 1.68 | 1.15 | 1.21 |

Com: Composition, (*): (% by mass)

1) The same as the refined mineral oil A of Table 1.

2) The same as the succinimide A of Table 1

3) The same as the zinc dithiophosphate A of Table 1

4) The same as the metallic detergent A of Table 1

5) Bis-polybutenylsuccinimide (bis type, number-average molecular weight of the polybutenyl group: 1000, nitrogen content: 2.0% by mass)

6) Boronated bis-polybutenylsuccinimide (bis type, number-average molecular weight of the polybutenyl group: 1000, nitrogen content: 2.0% by mass, boron content: 0.4% by mass)

Apparent from the results of Tables 1 and 2, all of the lubricating oil compositions of Examples 1 to 5 of the present invention have very excellent sludge formation inhibiting effects.

On the contrary, in any of the cases where the component (A) is not contained (Comparative Example 1), the component (B) is not contained (Comparative Example 2), the component (C) is not contained (Comparative Example 3), and commonly used succinimide is used in place of the component (A) (Comparative Examples 4 and 5), sludge is formed in extremely large amounts as compared with the lubricating oil composition of the examples, and hence the performances as the lubricating oil are inferior.

While the presently preferred embodiments of the present invention have been shown and described, it will be understood that the present invention is not limited thereto, and that various changes and modifications may be made by those skilled in the art without departing from the scope of the invention as set forth in the appended claims.

What is claimed is:

1. A lubricating oil composition comprising:

a lubricating base oil;

(A) 0.5 to 20% by mass of acylated bissuccinimide represented by the following general formula (1):

(1)

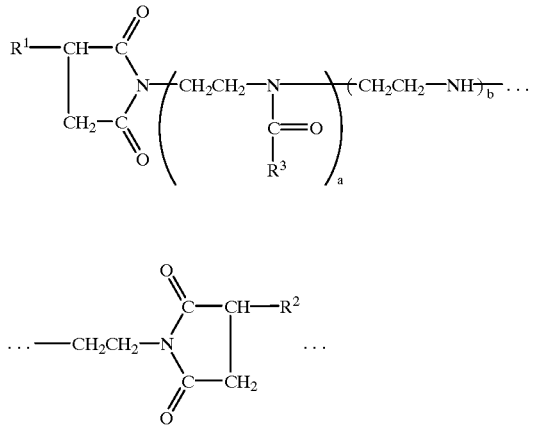

where $R^1$ and $R^2$ are each independently a straight or branched alkyl group or alkenyl group having 40 to 400 carbon atoms; $R^3$ is an alkoxy group having 1 to 24 carbon atoms or a hydroxy(poly)oxyalkylene group represented by $—O—(R^4O)_cH$ where $R^4$ is an alkylene group having 1 to 4 carbon atoms, and c is an integer of 1 to 5; and a is an integer of 1 to 4, b is an integer of 0 to 3, and a+b=1 to 4;

(B) 0.05 to 0.3% by mass of zinc dithiophosphate in terms of the phosphorous content; and (C) 0.5 to 4.0% by mass of a metallic detergent in terms of the sulfated ash content, based on the total mass of the composition.

2. The lubricating oil composition according to claim 1, wherein said acylated bissuccinimide is one represented by said general formula (1) where a is an integer of 2 to 4, b is an integer of 0 to 2, and a+b=2 to 4.

3. The lubricating oil composition according to claim 1, wherein said acylated bissuccinimide is one represented by said general formula (1) where a is an integer of 3 or 4, b is an integer of 0 or 1, and a+b=3 or 4.

4. The lubricating oil composition according to claim 1, wherein said acylated bissuccinimide is one represented by said general formula (1) where $R^1$ and $R^2$ are each independently a branched alkenyl group having 40 to 400 carbon atoms, or a branched alkyl group having 40 to 400 carbon atoms which is a hydride thereof, derived from one selected from the group consisting of polypropylene, ethylene-propylene oligomer, and polyisobutylene, each having a number-average molecular weight of 900 to 3500; c is an integer of 1 to 4; and a is an integer of 2 to 4, b is an integer of 0 to 2, and a+b=2 to 4.

5. The lubricating oil composition according to claim 1, wherein said acylated bissuccinimide is represented by said general formula (1) where $R^1$ and $R^2$ are each independently a branched alkenyl group having 40 to 400 carbon atoms, or a branched alkyl group having 40 to 400 carbon atoms which is a hydride thereof, derived from one selected from the group consisting of polypropylene, ethylene-propylene oligomer, and polyisobutylene, each having a number-average molecular weight of 1000 to 2000; c is an integer of 1 to 4; and a is an integer of 3 or 4, b is an integer of 0 or 1, and a+b=3 or 4.

6. The lubricating oil composition according to claim 1, wherein said metallic detergent is one basic alkaline earth metal-based detergent selected form the group consisting of a basic alkaline earth metal sulfonate having a total base number of 100 to 450 mgKOH/g, a basic alkaline earth metal phenate having a total base number of 20 to 450 mgKOH/g, a basic alkaline earth metal salicylate having a total base number of 100 to 450 mgKOH/g, and a mixture thereof.

7. The lubricating oil composition according to claim 1, wherein said zinc dithiophosphate is represented by the following general formula (11);

(11)

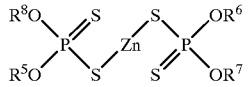

where $R^5$, $R^6$, $R^7$ and $R^8$ are each independently an alkyl group or aryl group having 1 to 18 carbon atoms, or an alkylaryl group having 8 to 18 carbon atoms.

8. The lubricating oil composition according to claim 7, wherein said zinc dithiophosphate is one selected from the group consisting of zinc dipropyldithiophosphate, zinc dibutyldithiophosphate, zinc dipentyldithiophosphate, zinc dihexyldithiophosphate, zinc diheptyldithiophosphate, zinc dioctyldithiophosphate, and a mixture thereof, wherein alkyl groups thereof are straight-chain or branched.

9. The lubricating oil composition according to claim 8, wherein said metallic detergent is one basic alkaline earth metal-based detergent selected form the group consisting of a basic alkaline earth metal sulfonate having a total base number of 100 to 450 mgKOH/g, a basic alkaline earth metal phenate having a total base number of 20 to 450 mgKOH/g, a basic alkaline earth metal salicylate having a total base number of 100 to 450 mgKOH/g, and a mixture thereof.

10. The lubricating oil composition according to claim 7, wherein said metallic detergent is one basic alkaline earth metal-based detergent selected form the group consisting of a basic alkaline earth metal sulfonate having a total base number of 100 to 450 mgKOH/g, a basic alkaline earth metal phenate having a total base number of 20 to 450 mgKOH/g, a basic alkaline earth metal salicylate having a total base number of 100 to 450 mgKOH/g, and a mixture thereof.

11. The lubricating oil composition according to claim 1, wherein the lubricating base oil has a kinematic viscosity at 100° C. of 1–10 $mm^2/s$., a viscosity index of at least 80 and a pour point of 0° C. or less.

12. A lubricating oil composition according to claim 11, wherein the acylated bissuccinimide is 1–15% by mass, the zinc dithiophosphate is 0.07–0.25% by mass and the metallic detergent is 0.7–3.5% by mass.

13. The lubricating oil composition according to claim 12, wherein the lubricating base oil has a kinematic viscosity at 100° C. of 2–8 $mm^2/s$., a viscosity index of at least 100 and a pour point of −5° C. or less.

14. The lubricating oil composition according to claim 1 in which b is 0.

15. The lubricating oil composition according to claim 14, wherein the acylated bissuccinimide is 1–15% by mass, the zinc dithiophosphate is 0.07–0.25% by mass and the metallic detergent is 0.7–3.5% by mass.

16. The lubricating oil composition according to claim 15, wherein the lubricating base oil has a kinematic viscosity at 100° C. of 1–10 $mm^2/s$., a viscosity index of at least 80 and a pour point of 0° C. or less.

17. The lubricating oil composition according to claim 1, wherein b is 1 to 3.

18. The lubricating oil composition according to claim 17, wherein the acylated bissuccinimide is 1–15% by mass, the zinc dithiophosphate is 0.07–0.25% by mass and the metallic detergent is 0.7–3.5% by mass.

19. The lubricating oil composition according to claim 18, wherein the lubricating base oil has a kinematic viscosity at 100° C. of 1–10 $mm^2/s$., a viscosity index of at least 80 and a pour point of 0° C. or less.

* * * * *